United States Patent [19]

Korn

[11] 4,250,584

[45] Feb. 17, 1981

[54] COLLAPSABLE SWIM FIN

[76] Inventor: Gerhard Korn, 378 N. Ave. 53, Los Angeles, Calif. 90042

[21] Appl. No.: 47,007

[22] Filed: Jun. 11, 1979

[51] Int. Cl.[3] ..... A63B 31/00

[52] U.S. Cl. ..... 9/304; 9/309

[58] Field of Search ..... 182/176; 416/72, 73, 416/70 R; 115/24.1; 9/301-309

[56] References Cited

U.S. PATENT DOCUMENTS

| | | | |
|---|---|---|---|
| 2,207,923 | 7/1940 | Kelso | 182/176 |
| 2,903,719 | 9/1959 | Wozencraft | 9/309 |
| 2,980,926 | 4/1961 | Wolshin | 9/309 |
| 3,037,219 | 6/1962 | Webb | 416/72 |
| 3,665,535 | 5/1972 | Picken | 9/309 |

FOREIGN PATENT DOCUMENTS

| | | | |
|---|---|---|---|
| 2802 | of 1855 | United Kingdom | 416/73 |

*Primary Examiner*—Trygve M. Blix
*Assistant Examiner*—D. W. Keen
*Attorney, Agent, or Firm*—Poms, Smith, Lande & Rose

[57] ABSTRACT

A collapsable swim fin includes a frame, a nonrigid blade or propulsion web, and tension members pivotally connected to the frame. The frame includes two slender, semirigid members extending forwardly from a swimmer's foot. The tensioning members include a pair of tension bars, each of which connect at one end to an opposite side of the frame members. The bars are pivotally interconnected at their other end, allowing movement of the bar members in a plane parallel with the blade. The blade or propulsion web is made of a collapsable material. Rotating the bars toward each other moves the frame members together and collapses the blade. Positioning the bars slightly past a colinear disposition to an overcenter orientation pushes the frame members apart, which tensions the blade material. The overcenter orientation causes the resilience of the propulsion webbing, in conjunction with a locking pin arrangement on the bars, to maintain the bars in a position to tension the propulsion webbing. The frame members attach to a swimmer's foot by a pair of straps which encircle the heel and the middle portion of the swimmer's foot, and by a pocket formed on the blade and enclosing encloses the forward portion of the swimmer's foot. The blade, in its collapsed form, is very compact and light and thus easily transportable.

14 Claims, 4 Drawing Figures

COLLAPSABLE SWIM FIN

FIELD OF THE INVENTION

This invention relates to swim fins, and in particular to swim fins which are collapsable.

BACKGROUND OF THE INVENTION

The vast majority of swim fins currently available are molded rubber devices which are generally heavy and cumbersome both in and out of the water. These characteristics make the transportation and storage of swim fins rather awkward.

Efforts to reduce the bulkiness of swim fins have been only marginally successful, as the resulting devices are usually somewhat complicated mechanically. Additionally, continuing development in the swim fin area is largely directed toward increasing the propulsion efficiency of swim fins, rather than toward increasing their portability and the space required to store them. The basic shape and weight of swim fins has not substantially changed in many years. Accordingly, swim fins continue to be large, awkward devices which are unwieldy to transport and which require a good deal of room to store.

No swim fin has yet been provided which is relatively lightweight and portable, and yet provides the proper propulsion in the water. A swim fin having these characteristics would be of great benefit to those who must frequently travel, and who would not otherwise carry swim fins because of their size and bulk.

Accordingly, it is a principal object of this invention to increase the transportability of swim fins.

It is an additional object of this invention to reduce the space required for storage of swim fins.

It is a final object of this invention to decrease the weight of swim fins.

SUMMARY OF THE INVENTION

The present invention, in a broad aspect, provides a collapsable swim fin which includes a supporting frame, a nonrigid propulsion webbing forming a blade and attached to the frame, and a tension member adjustably connected to the frame. The tension member positions the frame selectively to either hold the propulsion webbing forming the blade under tension, or to permit the collapse of the blade.

In accordance with one feature of the invention, the frame includes two semirigid frame members constructed of fiberglass, plastic, or any other easily-formable material. Each of the frame members is a slender member having substantially planar sides formed into three distinct portions. The first portion is disposed immediately adjacent to the swimmer's foot. The second portion diverges outwardly from the first portion. The third portion extends forwardly from the second portion in parallel relation to the side of the foot and with one of the planar sides in parallel relation to the bottom of the foot. The tension member is selectively mounted on each of the frame members at the junction of the second and third portions. The tension member may be formed of two parts, hingedly secured together and to the two frame members in an over-center latching configuration, with the stretched propulsion webbing providing the resilience for the latching effect.

In accordance with another feature of the invention, the two parts of the tension member are a pair of slender bars, each pivotally connected at one end to the frame and at the other end to the other bar. The bars position the frame members together or apart, under urging from the swimmer, to collapse or to rigidize the blade. Movement of the bars when the frame has been rigidized is resisted by the overcenter latching, which includes the engaging of a pin in one bar with a slot in the other bar. The overcenter latching positions the bars slightly past a colinear orientation, with the stretched propulsion webbing, in conjunction with the pin and slot arrangement, holding the blade in a rigidized state.

The orientation of the third portion of the frame in parallel relation with the bottom of the foot allows the bars move in a axis parallel with the blade portion of the swim fin. Thus, when a swimmer moves the bars forwardly, which causes the bars to rotate toward each other, the frame members are likewise brought together, thus collapsing the swim fin. The collapsed swim fin requires only a small volume to store, and the lightweight nature of the blade results in the collapsed swim fin having a very low weight.

In accordance with another feature of the invention, the nonrigid blade or propulsion webbing, is formed of a flexible material attached to the frame members. This material may be of nylon cloth, dacron, plastic film, or any other material having a low coefficient of friction or "drag" in water. The material may be attached to the frame members by sewing, lacing, or the like.

In accordance with still another feature of the invention, the swim fin is attached to the foot of the swimmer by a extra section of waterproof material attached to and defining a pocket upon the waterproof material forming the blade. The pocket is open at both ends and is of a size to enclose the forward portion of the swimmer's foot. Such a pocket may be made openable by means of snaps, Velcro strips or the like. The other portions of the swimmer's foot are attached to the swim fin by means of two straps connected to the ends of the frame members closest to the swimmer's foot. The first strap completely encircles the middle portion of the foot, and the second passes around the heel of the foot. The first strap may be provided with snaps of Velcro strips to facilitate the donning of the swim fin. The straps may be constructed of nylon webbing to further enhance the lightweight nature of the swim fin.

Other objects, features, and advantages of the present invention will become apparent from a consideration of the following detailed description and from the accompanying drawings.

DETAILED DESCRIPTION

Figure 1:
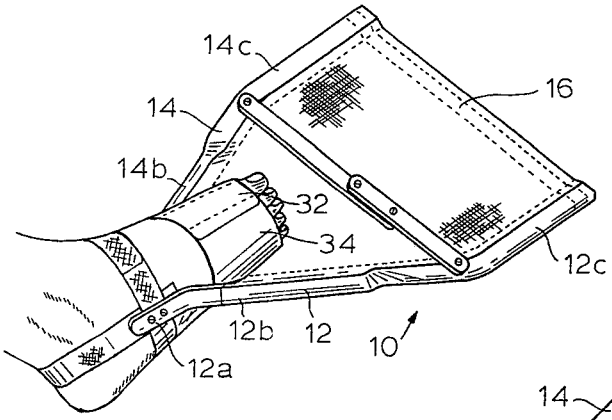
FIG. 1 is an isometric view of a collapsable swim fin illustrating the principles of the present invention.

Referring more particularly to the drawings, FIG. 1 shows an isometric view of a collapsable swim fin illustrating the principles of the present invention. The swim fin, generally denoted 10, includes a frame, to which is attached a collapsable blade member 16 and an assembly to attach the frame to a swimmer's foot.

The frame includes a left frame member 14 and a right frame member 12. Each of the frame members is constructed of a semi-rigid material. In a prototype version of the invention, fiberglass sail battens were used to form the frame members 12 and 14. Fiberglass is especially attractive to construct the frame members, as is may be easily shaped by bending after the application of heat. The frame members however can be also injection-molded of plastic or nylon to achieve the desired shape. As shown in the figures, each of the frame members 12 and 14 is a slender member having substantially planar sides.

Each of the frame members 12 and 14 has three distinct portions 12*a* and 14*a*, 12*b* and 14*b*, and 12*c* and 14*c*. The first of these portions 12*a* and 14*a* places the first several inches of the frame member adjacent to the middle portion of the swimmer's foot, with the flat portion of the member directly against the swimmer's foot. The second portion 12*b* and 14*b* of the frame members the frame members diverges outwardly from the first portion along the forward one-third of the swimmer's foot. This outward divergence continues for several inches ahead of the swimmer's foot. In the third portion 12*c* and 14*c* of the frame members 12 and 14, the divergence of the second portion changes and the frame members 12 and 14 extend directly forward in parallel relation to the side of the swimmer's foot. This forward extension has a length of approximately six to eight inches and supports the portion of the blade 16 which provides the majority of the thrust.

The third or forward portion 12*c* and 14*c* of the frame members 12 and 14 is formed with the flat sides of the frame members in parallel relation to the bottom of the swimmer's foot. This orientation not only provides the necessary flexibility in the blade portion of the swim fin, but also provides a mounting surface for the tensioning members which make possible the collapsable nature of the swim fin. As seen in FIG. 1, the tensioning members include a left bar member 24 and a right bar member 22. Each bar is connected to its respective frame member by a stainless steel rivet 20 and 18. Other types of fasteners also could be used, however, to affix the bars to the frame members such as stainless steel pins, nut and bolt assemblies, etc. Additionally, the bar members 24 and 22 may be constructed of the same material used for the left and right frame members 12 and 14.

Figure 2:
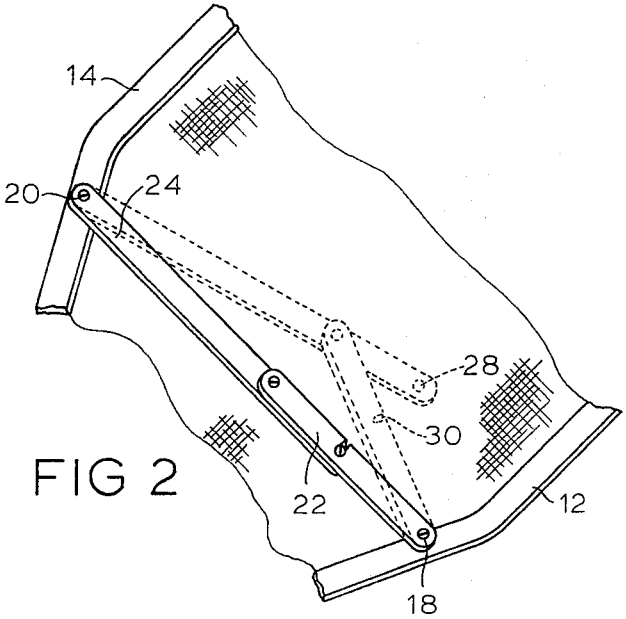
FIG. 2 is an isometric view of the hinge portion of the swim fin shown in FIG. 1.
Figure 3:
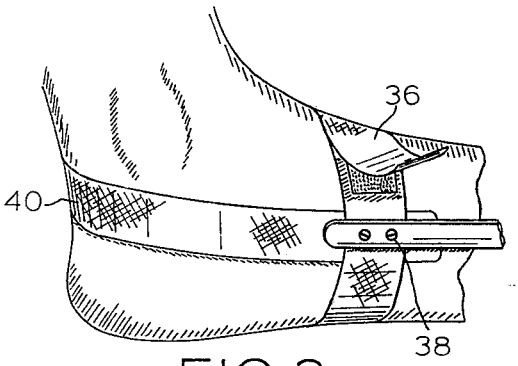
FIG. 3 is an isometric view of the heel portion of the swim fin shown in FIG. 1 which attaches to a swimmer's foot.

To rigidize the propulsion webbing 16 forming the blade in order to use the swim fin 10, the bar members 22 and 24 are positioned as shown in FIG. 2. This orientation places the bar members 22 and 24 slightly past a colinear disposition relative to a line between the rivets 18 and 20 on the frame members 12 and 14 to achieve an overcenter locking or toggling which resists pivoting of the bar members. When in the overcenter orientation, the resilience of the blade material 16, in conjunction with the engaging of the locking pin 28 with the slot 30, maintains the "locked" orientation of the bar members 22 and 24. The locked orientation of the bar members is such that the left and right frame members 12 and 14 are positioned to sufficiently tension the collapsable blade material to form a rigid blade.

The blade portion 16 of the swim fin 10 is formed by a section of collapsable material attached to the left and right frame members 14 and 16. The material 16 is attached to the second 12*b* and 14*b* and third 12*c* and 14*c* portions of the frame members 12 and 14. This material 16 may be nylon, dacron, or any other collapsable material having a low coefficient of friction or "drag" in the water. In the figures, the material 16 is shown sewn to the frame members 12 and 14. In practice, however, the material may be attached to the frame members by snaps, lacing, or any similar technique.

Figure 4:
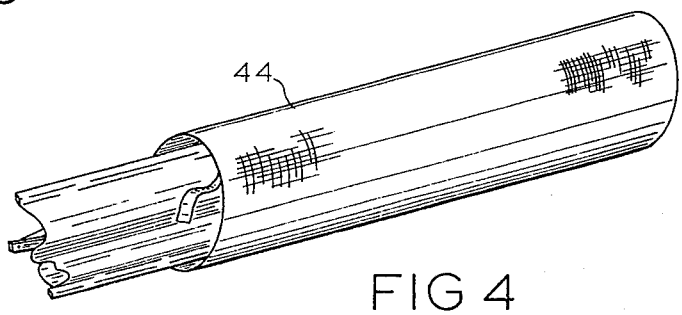
FIG. 4 is an isometric view of the swim fin in FIG. 1 in its collapsed state and rolled for insertion into a carrying tube.

As shown in FIG. 4, the left and right bar members 24 and 22 collapse of the swim fin 10 when moved away from an approximately colinear orientation. The collapsing occurs when the swim fin user pushes the bars 24 and 22 forwardly at the joint pin 26. This causes the bar members 24 to pivot away from the overcenter orientation in a plane parallel to the blade 16. The pivoting causes disengagement of the locking pin 28 with the slot 30. Accordingly, the left and right frame members 14 and 12 move towards each other and thus collapse the blade 16. The collapsability of the blade material 16 allows the collapsed swim fin to be of very small proportions. As shown in FIG. 4, the collapsed swim fin may be easily fit into a tube of approximately one inch in diameter by one and one-half feet in length.

Regarding the manner in which the swim fin is attached to the swimmer's foot, it is seen from FIG. 1 that the section of the blade 16 material between the second portion 12*b* and 14*b* of the left and right frame members 12 and 14 has sewn onto it a pocket 34. Into the pocket 34 is inserted the forward portion of the swimmer's foot. The pocket 34 can be formed of the same material as the blade material 16, and may be open at each end to simplify construction. Additionally, the pocket 34 may be formed of two flaps of overlapping material which are connected together by snaps, or by complementary strips of interlocking pile material such as Velcro. Such a Velcro strip is shown in diagramatic form at 32 in FIG. 1.

The frame members 14 and 12 are also attached to the swimmer's foot by means of two straps 36 and 40 attached to the ends of the frame members 12 and 14 closest to the swimmer's foot. Each of these straps may be made of nylon webbing or similar material, or may be made of elastic or rubber material. The first strap 36 encircles the middle portion of the swimmer's foot. As is the case with the pocket 34 on the blade 16, this strap 36 may be constructed of overlapping strap sections interconnected by snaps, Velcro, or any other fastening means. This strap is attached to the left and right frame members 14 and 12 by two rivets or similar fasteners 38. The other strap 40 encircles the swimmer's heel. This strap 40 also attaches to the frame members 12 and 14 by means of rivets 38 or similar fastening means.

The use of such strap material enhances the compactness of the collapsed swim fin 10, as it may be folded between the frame members 14 and 12 when the swim fin is in a collapsed state. Thus, and as shown in FIG. 4, a carrying tube for the collapsed swim fin need only be as long as the frame members 14 and 12. The semi-rigidity of the frame members 14 and 12 allow them to be sufficiently deformed to fit in approximately parallel relation within the carrying tube 44.

In the foregoing description of the present invention, a preferred embodiment of the invention has been disclosed. It is to be understood that other mechanical and design variations are within the scope of the present invention. Thus, by way of example and not of limitation, different types of flexible sheet material could be used to form the blade or frame portions of the swim fin; the tension member holding the frame members in rigid orientation when the swim fin is being utilized could be disposed differently in relation to the frame members, and could, for example, be a single semi-rigid member with notches at each end for securing to points 18 and 20 of the frame or could be an pneumatically operated tension member; different means could be utilized to lock the tension members together; and alternative arrangements could be utilized to attach the fin to a swimmer's foot. Accordingly, the invention is not limited to the particular arrangement which has been illustrated and described in detail.

What is claimed is:

1. A collapsable fin comprising:

frame means for supporting said swim fin;

nonrigid blade means, attached to said frame means, for providing propulsion;

means for attaching said swim fin to a swimmer's foot;

tension means, adjustable connected to said frame means, for selectively positioning said frame means, to either tension or to collapse said nonrigid blade means; and said frame means comprising two semi-rigid frame members each comprising a slender member having substantially planar sides divided into three distinct portions, with said first portion being disposed along one side of said foot attaching means, with the second portion diverging outwardly from said first portion, and with the third portion extending forwardly from said second portion in parallel relation to the sides of said foot and with one of said planar sides disposed in generally parallel relation with the bottom of said foot.

2. A collapsable swim fin as defined in claim 1, wherein said blade means comprises a flexible sheet of material attached to said frame means.

3. A collapsable swim fin as defined in claim 2, wherein said foot attaching means includes a pocket formed in aid flexible sheet material.

4. A collapsable swim fin as defined in claim 1, wherein said tension means comprises over-center toggle means, extending between opposite portions of said frame means, for lockingly positioning said frame means to tension said blade means.

5. A collapsable swim fin as defined in claim 1, wherein said tension means extends between said two semi-rigid frame members and substantially between said second and third portions thereof.

6. A swim fin as defined in claim 1, wherein said tension means comprises:

a pair of slender bars, each of said bars being pivotally connected at one end to said frame members, and said bars being pivotally connected to each other near their other ends, said pivotal connection moving said frame members together or apart, under urging from said swimmer, to collapse or to rigidize said blade means, said bars being positioned slightly past a colinear orientation when said blade means is tensioned, said positioning utilizing said tensioned blade means to resist pivoting of said bars; and means for further resisting pivoting of said bars when said bars have positioned said frame members apart to tension said material.

7. A swim fin as defined in claim 6, wherein said means for further resisting comprises:

a slot defined in one of said bars; and a pin member attached to the other of said bars, said pin member engaging said slot, whereby pivoting of said bars is resisted when said bars are positioned to tension said blade means by said engagement of said pin member with said slot in conjunction with said positioning past a colinear orientation.

8. An improved swim fin of the type having means forattaching said fin to a foot and blade means for propulsion, wherein the improvement comprises:

the blade being formed of flexible material;

means for selectively holding said blade means extended and for collapsing said blade means;

said blade means including semi-rigid frame means for supporting said blade means; and a sheet of flexible material attached to said frame means; and said frame means comprises a pair of slender frame members, each having two substantially planar sides positioned along each side of foot and extending forwardly from said foot, each of said members having three portions, with the first portion being disposed adjacent to said foot, with second portion diverging outwardly from said first portion, and with the third portion extending forwardly from said second portion in parallel relation with the sides of said foot and with one of said planar sides disposed in generally parallel relation with the bottom of said foot.

9. A swim fin as defined in claim 8, wherein said means for selectively holding said blade means extended and for collapsing said blade means comprises:

a first tensioning member pivotally attached to one side of said blade means ahead of said foot and extending more than halfway across said blade means;

a second tensioning member pivotally connected to the side of said blade means opposite said first tensioning member, said second member extending approximately halfway across said blade means and being pivotally connected to said first member, said extension of said second member allowing said first and second members to pivot slightly past a colinear orientation to tension said blade means, whereby said tensioned blade means resists movement of said tensioning members, and said pivotal connection allows the collapsing of said blade when said first and second tensioning members are pivoted in a plane parallel to said blade means; and means for further resisting pivoting of said first and second tensioning members when said blade means is in a tensioned state.

10. A swim fin as defined in claim 9, wherein said means for further resisting comprises:

a slot defined in said second hinge member and disposed adjacent to said end of said first hinge member; and pin means, attached to the end of said first hinge member nearest said second member, for latchingly engaging said slot, whereby said latching engagement, in conjunction with said orientation of said tensioning members, resists pivoting of said tensioning members when said blade means is tensioned.

11. A swim fin as defined in claim 8, wherein said attaching means comprises:

an additional sheet of flexible material attached to said sheet of flexible material in a manner forming a pocket for the forward portion of said foot;

first strap means, connected to said frame members and passing across the heel of said foot, for affixing said swim fin to the rear portion of said foot; and second strap means, connected to said frame members and encircling the middle portion of said foot, for attaching said swim fin to said foot.

12. A swim fin as defined in claim 1, wherein:

said additional sheet of flexible material is divided into two overlapping sections, and further comprises means for connecting said sections; and said second strap means is divided into two overlapping sections and further comprises means for connecting said sections.

13. A swim fin as defined in claim 12 wherein both of said means for connecting comprise complementary strips of interlocking pile material attached to said overlapping sections.

14. A collapsable swim fin comprising:

frame means for supporting said swim fin;

nonrigid blade means, attached to said frame means, for providing propulsion;

means for attaching said swim fin to a swimmer'foot; said attaching means incuding: a section of nonrigid material attached to said blade means and defining a pocket, said pocket being openable to allow easy insertion of said foot; first strap means, connected to said frame means and passing over the heel of said foot, for affixing the rear portion of said foot to said swim fin; and second strap means, attached to said frame means and encircling the middle portion of said foot, for preventing movement of said foot relative to said frame means, said second strap means being openable to allow easy insertion of said foot; and tension means, adjustably connected to said frame means, for selectively positioning said frame means, to either tension or to collapse said nonrigid blade means.

* * * * *